US008408388B1

(12) United States Patent
Chen

(10) Patent No.: US 8,408,388 B1
(45) Date of Patent: Apr. 2, 2013

(54) LOCKING STRUCTURE FOR A TOOL BOX

(71) Applicant: Ander Chen, Chang-Hwa (TW)

(72) Inventor: Ander Chen, Chang-Hwa (TW)

(73) Assignee: Infar Industrial Co., Ltd., Chang-Hwa (TW)

( * ) Notice: Subject to any disclaimer, the term of this patent is extended or adjusted under 35 U.S.C. 154(b) by 0 days.

(21) Appl. No.: 13/649,318

(22) Filed: Oct. 11, 2012

(51) Int. Cl.
*B65D 85/28* (2006.01)

(52) U.S. Cl. ..... 206/45.24; 206/376

(58) Field of Classification Search ..... 206/372, 206/373, 376, 45.2, 45.23, 45.24, 377; 211/70.6
See application file for complete search history.

(56) References Cited

U.S. PATENT DOCUMENTS

| | | | | |
|---|---|---|---|---|
| 5,505,316 | A * | 4/1996 | Lee | 211/70.6 |
| 6,464,840 | B1 * | 10/2002 | McCann | 206/349 |
| 6,896,136 | B2 * | 5/2005 | Hu | 206/378 |
| 7,987,975 | B1 * | 8/2011 | Lee | 206/45.23 |
| 7,987,981 | B1 * | 8/2011 | Lee | 206/376 |
| 2005/0051445 | A1 * | 3/2005 | Meehan et al. | 206/372 |
| 2005/0051446 | A1 * | 3/2005 | Chen | 206/376 |
| 2006/0096878 | A1 * | 5/2006 | Chen | 206/376 |

* cited by examiner

*Primary Examiner* — Jacob K Ackun

(57) ABSTRACT

A locking structure for the box body is provided with a box body, a handle, and a cover. The handle is a rotatable structure which can support the box body to make the box body stand in an inclined manner, so as to allow the user to have a full clear view of the hand tools inside the tool box. On top of that, the tool box offers an antitheft feature, when the tool box is closed, the cover cannot be opened and removed from the box body unless the locking ends of the retainers are destroyed. Therefore, the hand tools cannot be taken out of the tool box without permission.

14 Claims, 7 Drawing Sheets

LOCKING STRUCTURE FOR A TOOL BOX

BACKGROUND OF THE INVENTION

1. Field of the Invention

The present invention relates to a locking structure for a tool box, and more particularly to the locking structure among the box body, the handle and the cover, which makes the tool box become a display hand tool box with antitheft protection.

2. Description of the Prior Art

Wrenches, screwdrivers and other hand tools are normally put in a tool box for display when being sold in a shop.

However, most of the existing tool boxes are opened in a flat-spread-out manner, and a user is unable to see the whole inside of the too box, making it inconvenient for the user to find out the desired hand tool. On top of that, the existing tool boxes are mostly not antitheft, and the hand tools are likely to be stolen when being displayed in the tool boxes.

The present invention has arisen to mitigate and/or obviate the afore-described disadvantages.

SUMMARY OF THE INVENTION

The primary objective of the present invention is to provide a locking structure among the box body, the handle and the cover of a tool box, wherein the handle is a rotatable structure which can support the box body to make the box body stand in an inclined manner, so as to allow the user to have a full clear view of the hand tools inside the tool box.

Another objective of the present invention is to provide an antitheft locking structure for a tool box, when the tool box of the present invention is closed, the cover can be tightly locked to the box body and cannot be opened and removed from the box body unless the locking ends of the retainers are destroyed. Therefore, the hand tools cannot be taken out of the tool box without permission.

To achieve the above objectives, a locking structure for a tool box in accordance with the present invention comprises: a box body, a handle, and a cover. The box body includes a top surface and two lateral surfaces at two sides of the top surface, on the top surface are provided two opposed lines of positioning hooks, at one end of the box body is formed an engaging groove, and at another end of the box body are formed two round pivoting holes which are located at the two lateral surfaces. The handle includes two assembling rods and a connecting portion connected to one end of each of the assembling rods. In the middle of each of the assembling rods is formed a rotating hole, and at another end of each of the assembling rods is formed a connecting pivot which is pivotally inserted in the pivoting holes of the box body, so that the handle is pivotally coupled to the box body. The cover includes an engaging end and a pivoting end, at each of two sides of the pivoting end is formed a rotating pivot, between the engaging end and the pivoting end is disposed a plate, the cover is pivoted to the handle by inserting the rotating pivots in the rotating holes of the handle.

To achieve the above objectives, a locking structure for a tool box in accordance with the present invention comprises: a box body, a handle, and a cover. The box body includes a top surface and two lateral surfaces at two sides of the top surface, on the top surface are provided two opposed lines of positioning hooks, at each of top and lower edges of the top surface of the box body is formed a positioning hole, at one end of the box body is formed an engaging groove, and at another end of the box body are formed two round pivoting holes which are located at the two lateral surfaces, an engaging portion and a positioning block are formed around each of the pivoting holes of the box body. The handle includes two assembling rods and a connecting portion connected to one end of each of the assembling rods, in the middle of each of the assembling rods is formed a rotating hole, at another end of each of the assembling rods is formed a connecting pivot which is pivotally inserted in the pivoting holes of the box body, so that the handle is pivotally coupled to the box body. Beside each of the connecting pivots are formed a locking groove and a stop cavity at the end of the locking groove, the engaging portions of the box body are restricted in the stop cavities, and an inferior angle is defined between the handle and the box body. The cover includes an engaging end and a pivoting end, between the engaging end and the pivoting end is disposed a plate, the cover is provided with two positioning retainers to be engaged with the positioning holes of the box body, the cover is pivoted to the handle via the pivoting end.

To achieve the above objectives, a locking structure for a tool box in accordance with the present invention comprises: a box body, a handle, and a cover. The box body includes a top surface and two lateral surfaces at two sides of the top surface, on the top surface are provided two opposed lines of positioning hooks, at each of top and lower edges of the top surface of the box body is formed a positioning hole, at one end of the box body is formed an engaging groove. The handle includes two assembling rods and a connecting portion connected to one end of each of the assembling rods, another end of each of the assembling rods is pivotally coupled to the box body. The cover includes an engaging end and a pivoting end, at a terminal edge of the engaging end is formed an engaging rib. The pivoting end is pivoted to the assembling rods of the handle, between the engaging end and the pivoting end is disposed a plate. The cover is provided with two positioning retainers to be engaged with the positioning holes of the box body, each of the positioning retainers is provided with a locking end, the cover is pivoted to the handle via the pivoting end, the engaging rib is engaged in the engaging groove of the box body, the locking ends are locked in the positioning holes, and when the locking ends are damaged or destroyed, the positioning retainers will be disengaged from the positioning holes of the box body.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
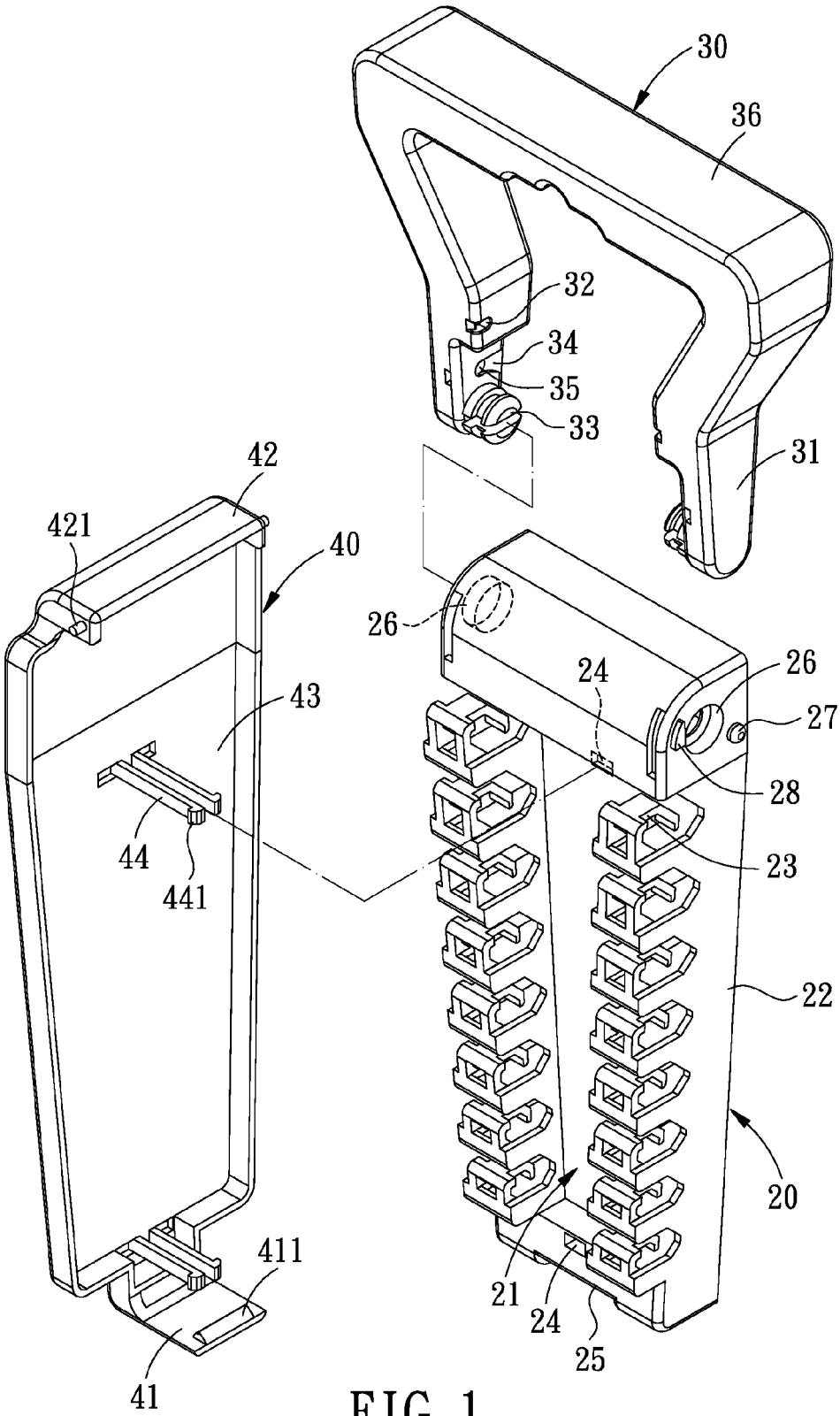
FIG. 1 is an exploded view of a locking structure for a tool box in accordance with the present invention.
Figure 2:
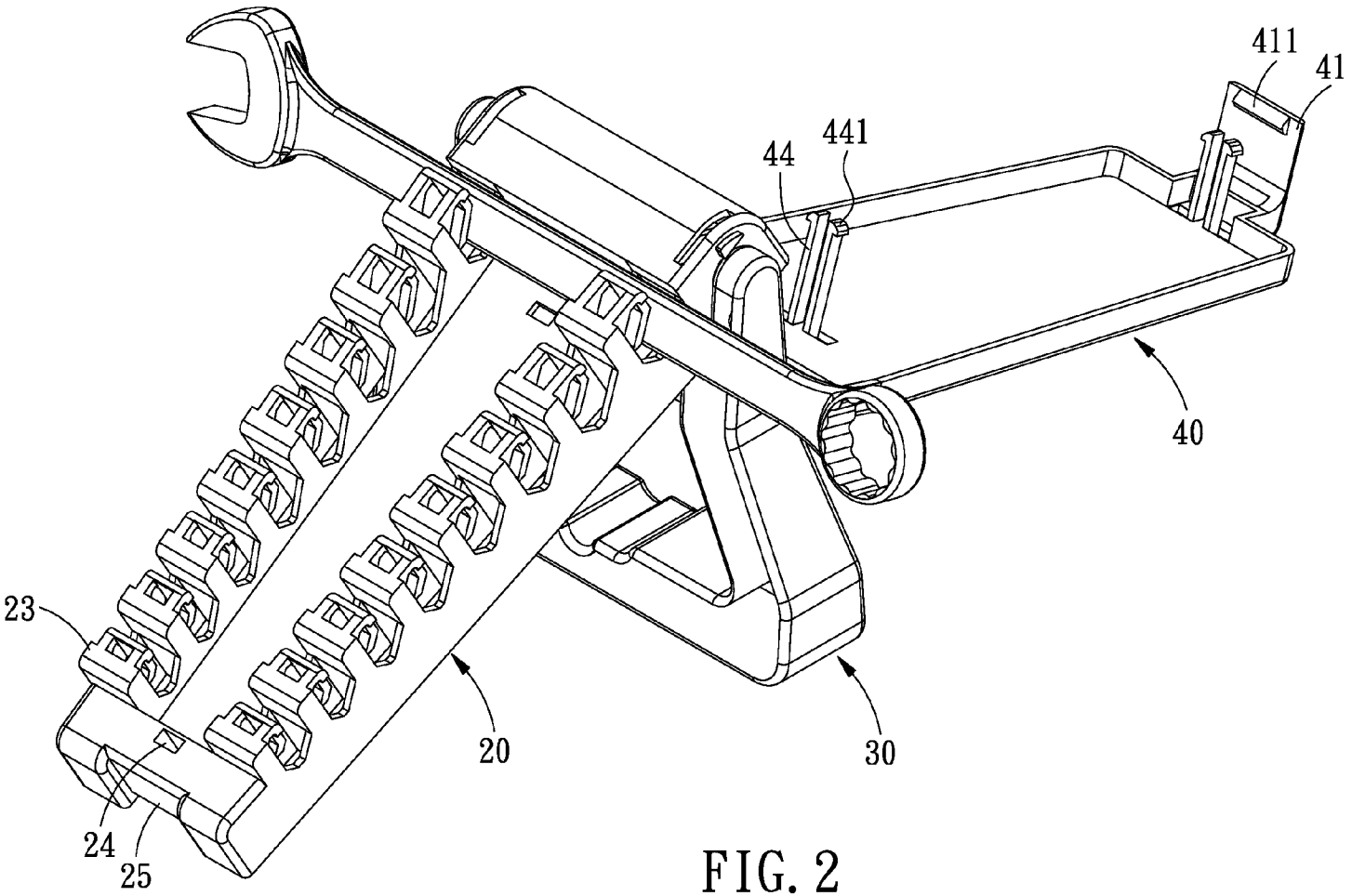
FIG. 2 is an operational view of the locking structure for a tool box in accordance with the present invention.

Referring to FIGS. 1 and 2, a locking structure for a tool box in accordance with the present invention comprises: a box body 20, a handle 30 and a cover 40.

The box body 20 includes a top surface 21 and two lateral surfaces 22 at two sides of the top surface 21. On the top surface 21 are provided two opposed lines of positioning hooks 23 which are arranged in an order from large to small. At each of the top and lower edges of the top surface 21 is formed a positioning hole 24. At one end of the box body 20 is formed an engaging groove 25, and at another end of the box body 20 is formed two round pivoting holes 26 which are located at the two lateral surfaces 22. Around each of the pivoting holes 26 are formed an engaging portion 27 and a positioning block 28.

The handle 30 includes two assembling rods 31 and a connecting portion 36 connected to one end of each of the assembling rods 31. In the middle of each of the assembling rods 31 is formed a rotating hole 32, and at another end of each of the assembling rods 31 is formed a connecting pivot 33 which has an outer diameter equal to or smaller than the inner diameter of the pivoting holes 26. Beside each of the connecting pivots 33 is formed a locking groove 34 and a stop cavity 35 at the end of the locking groove 34. The connecting pivot 33 at the another end of each of the assembling rods 31 is pivotally inserted in the pivoting holes 26 of the box body 20, so that the handle 30 is pivotally coupled to the box body 20, and the pivot angle of the handle 30 with respect to the box body 20 is restricted by the positioning block 28 and the engaging portion 27.

The cover 40 includes an engaging end 41 and a pivoting end 42. At a terminal edge of the engaging end 41 is formed an engaging rib 411, and at each of two sides of the pivoting end 42 is formed a rotating pivot 421. Between the engaging end 41 and the pivoting end 42 is disposed a plate 43 which is provided with two positioning retainers 44 to be engaged with the positioning holes 24. Each of the positioning retainers 44 has a locking end 441. The cover 40 is pivoted to the handle 30 by inserting the rotating pivots 421 in the rotating holes 32, the engaging rib 411 at the engaging end 41 is engaged in the engaging groove 25 of the box body 20, and the positioning retainers 44 with the locking ends 441 are engaged in the positioning holes 24 of the box body 20.

The mentioned above are the structural relations of the main parts of the locking structure for a tool box in accordance with the present invention.

Figure 3:
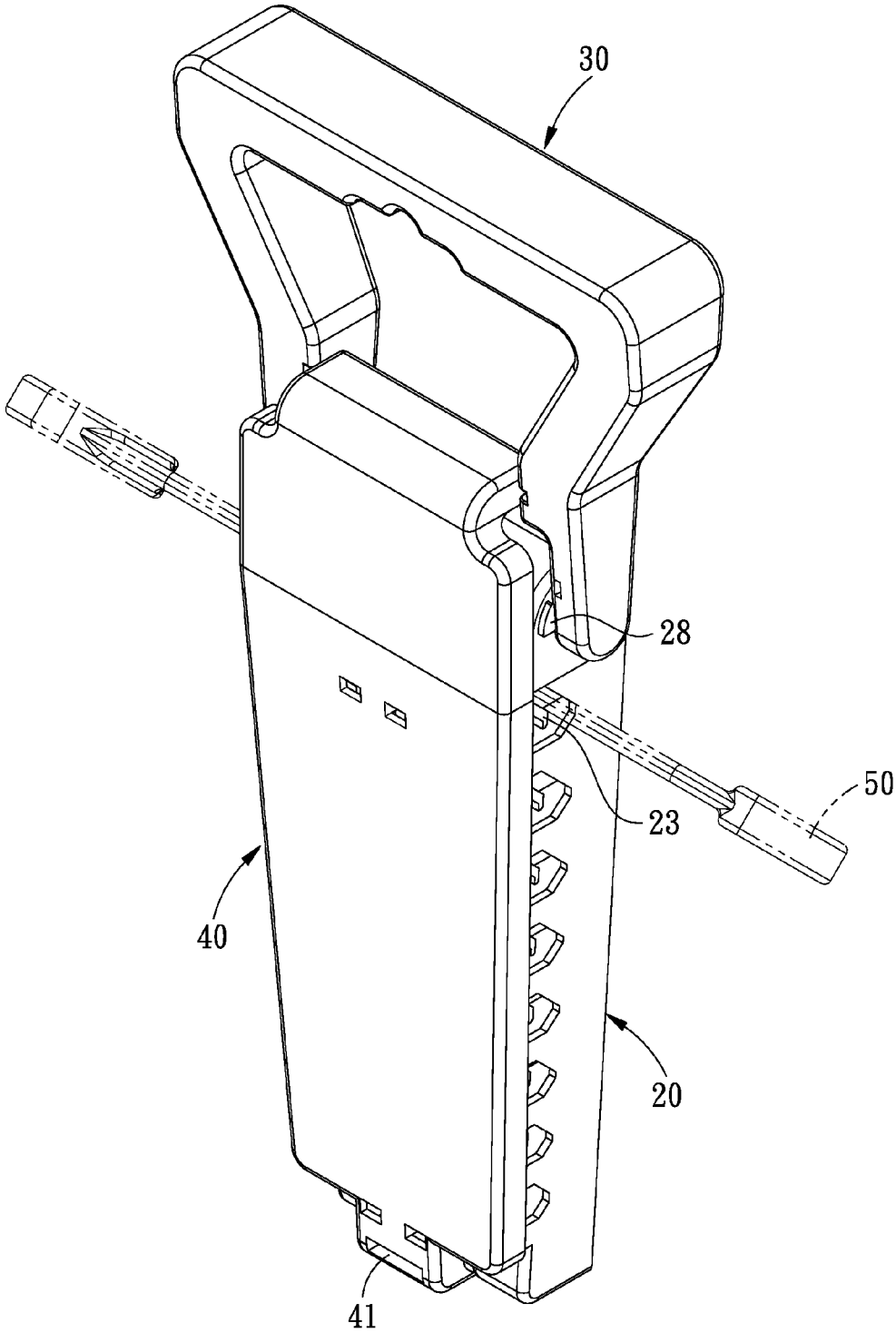
FIG. 3 is another operational view of the locking structure for a tool box in accordance with the present invention.

For a better understanding of the operation and functions of the present invention, reference should be made back to FIGS. 1-3 again. In assembly, the box body 20 serves as a base, the connecting pivots 33 of the handle 30 are inserted into the pivoting holes 26 of the box body 20 to make the handle 30 pivoted to the box body 20. Then the rotating pivots 421 of the cover 40 are engaged in the rotating holes 32 of the handle 30 to allow the cover 40 to be rotatable with respect to the handle 30, so that the assembling of the tool box of the present invention. At this moment, the tool box is open, and the positioning hooks 23 of the box body 20 are provided for holding different sized hand tools 50. After that, the positioning retainers 44 of the cover 40 are engaged in the positioning holes 24 of the box body 20, and the engaging rib 411 at the engaging end 41 is engaged in the engaging groove 25 of the box body 20, so that the box body 20 is sealed with the cover 40, namely, the tool box is closed.

Figure 4:
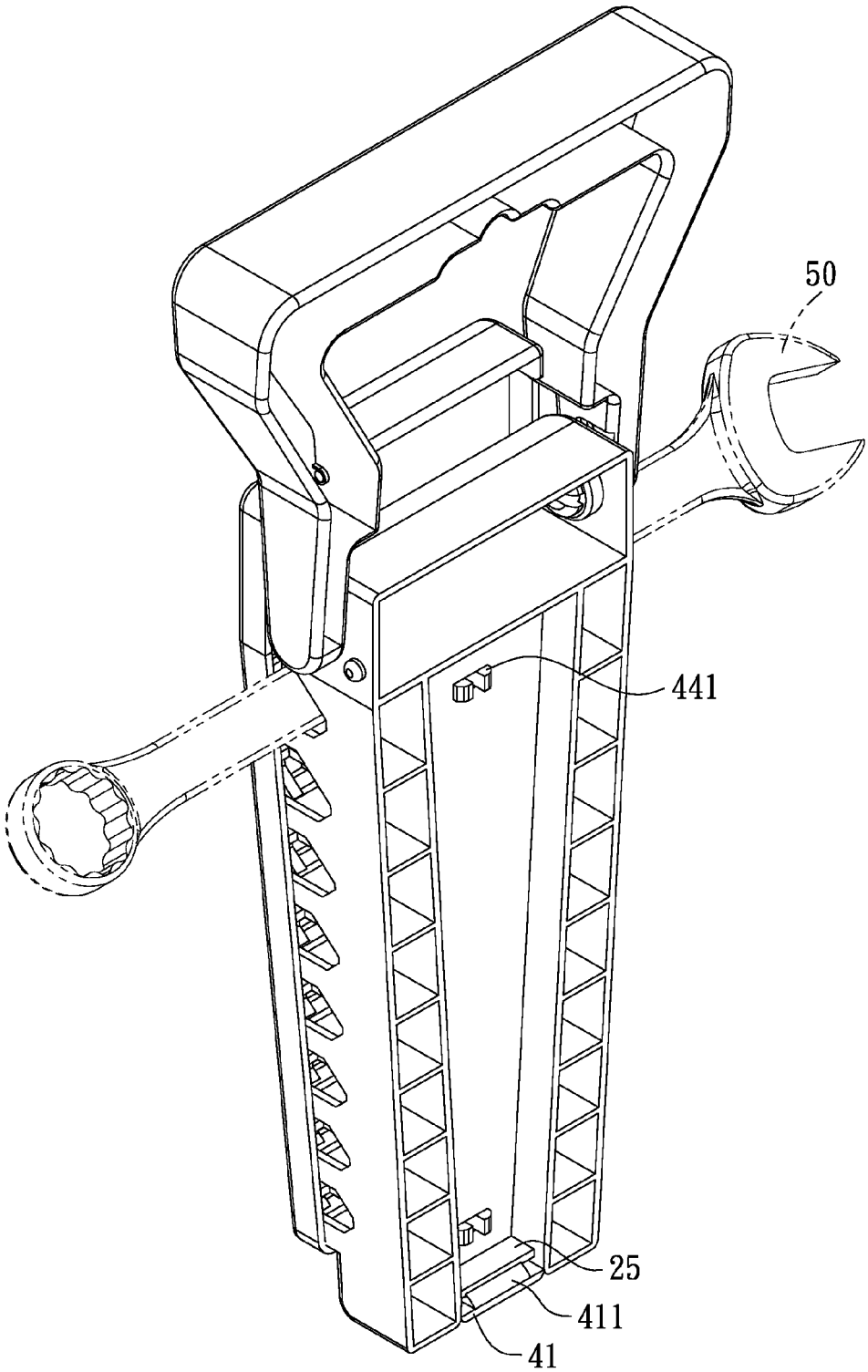
FIG. 4 is another operational view of the locking structure for a tool box in accordance with the present invention.

It is to be noted that, as shown in FIGS. 1 and 4, when the tool box of the present invention is closed, the engaging rib 411 at the engaging end 41 is engaged in the engaging groove 25 of the box body 20, and the positioning retainers 44 with the locking ends 441 are engaged in the positioning holes 24 of the box body 20. With the locking ends 441 engaged in the positioning holes 24 of the box body 20, the cover 40 can be tightly locked to the box body 20, and the cover 40 cannot be opened and removed from the box body 20 unless the locking ends 441 of the positioning retainers 44 are destroyed. Therefore, the hand tools 50 cannot be taken out of the tool box without permission.

Figure 5:
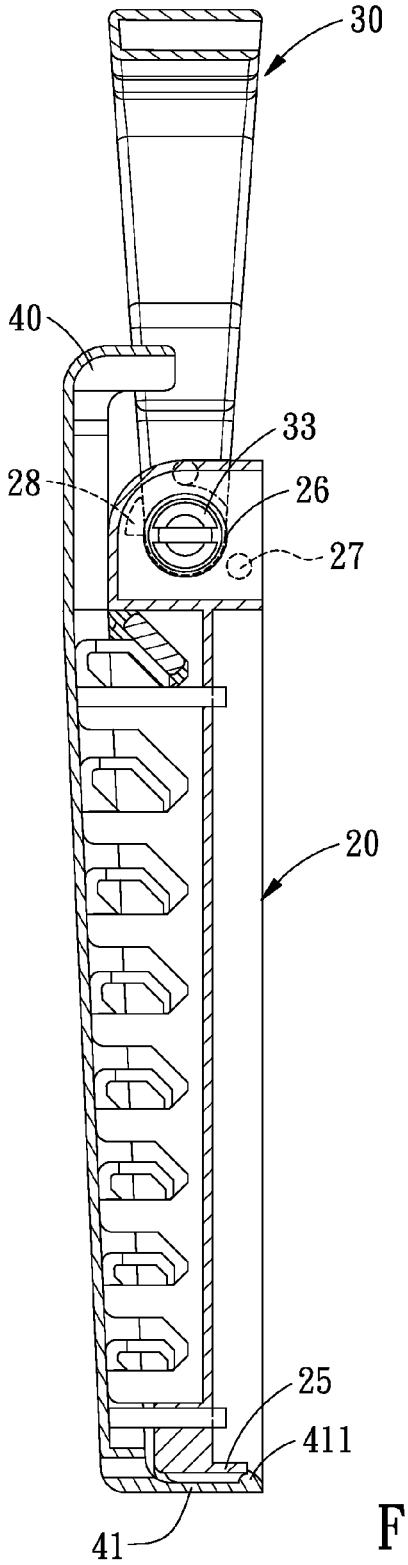
FIG. 5 is a side view of the locking structure for a tool box in accordance with the present invention.

Referring to FIG. 5, when the tool box of the present invention is closed, the engaging rib 411 at the engaging end 41 is engaged in the engaging groove 25 of the box body 20, the handle 30 is coupled to the cover 40, and the connecting pivots 33 of the handle 30 are inserted into the pivoting holes 26 of the box body 20 to make the handle 30 rotatably coupled to the box body 20, so that the three connection points (including the connecting points between the cover 40 and the box body 20, between the handle 30 and the cover 40, and between the handle 30 and the box body 20) are located on the same line. Therefore, the box body 20 won't swing with respect to and will be on the same line with the handle 30, when a user carry the tool box by lifting the handle 30. When the tool box is closed, the box body 20, the handle 30 and the cover 40 will be locked to one another to form a stable structure for facilitating carrying. When the handle 30 is pivoted to a position above the box body 20, it will be stopped by the positioning blocks 28 from pivoting further upward, making the tool box of the present invention become more stable.

Figure 6:
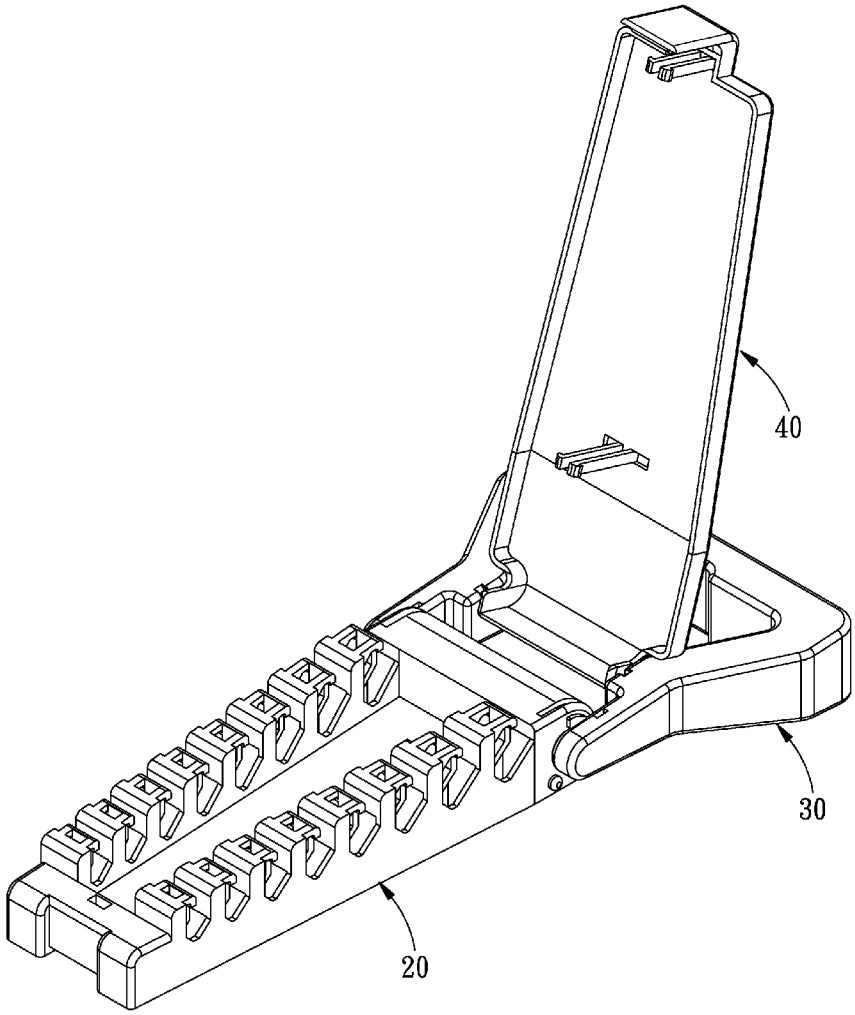
FIG. 6 is an illustrative view showing that the tool box in accordance with the present invention is opened with the handle and box body laid flatly.
Figure 7:
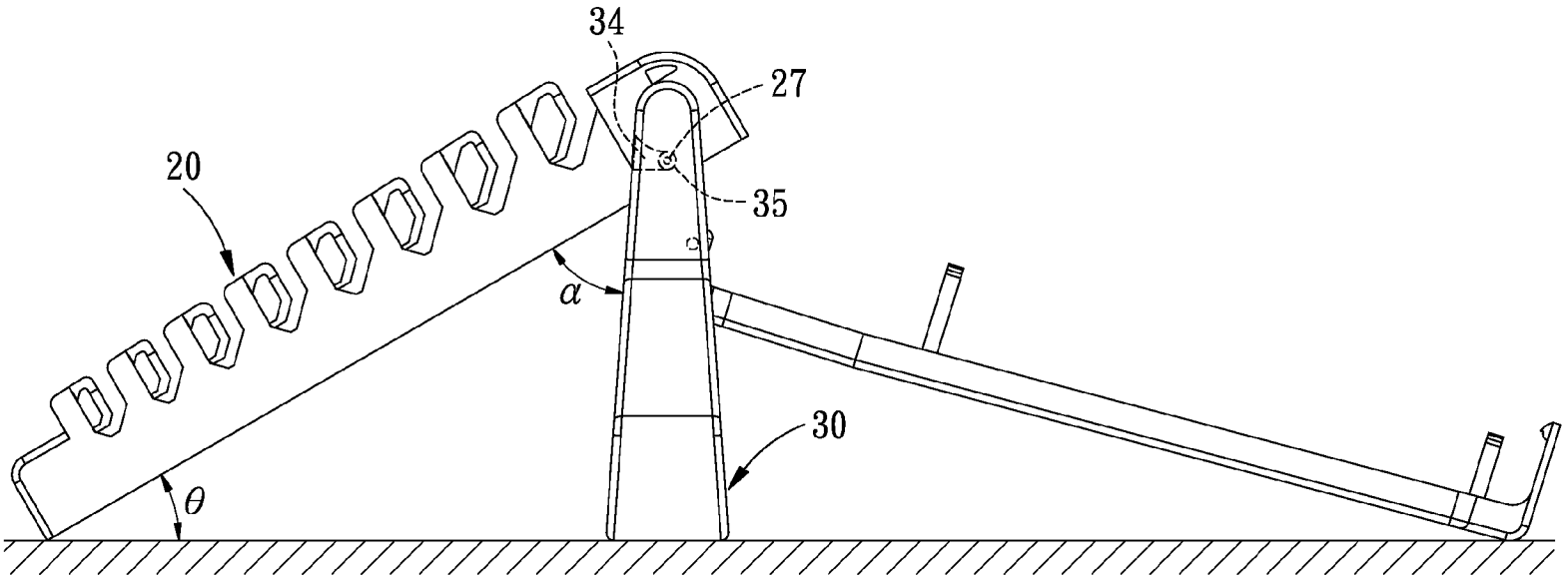
FIG. 7 is an illustrative view showing that the tool box in accordance with the present invention is opened with the handle standing upright and the box body standing in an inclined manner.

The tool box of the present invention can be opened in different ways. For example, as shown in FIG. 6, the box body 20 and the handle 30 are laid flat on the ground or on a table, and the cover 40 is opened and leans against the handle 30, making it easy for the user to see and take out the tools inside the tool box. As shown in FIG. 7, the handle 30 stands on the ground as a support structure, the user just needs to move the handle 30 toward the engaging portions 27 to make the engaging portions 27 engaged in the locking grooves 34 and restricted in the stop cavities 35, so that the handle 30 can stably stand on the ground to support the box body 20 in such a manner that there is an inferior angle $\alpha$ (60 degrees, for instance) between the handle 30 and the box body 20, and the box body 20 is inclined to define an acute angle $\theta$ (such as 30 degrees) with respect to a surface (such as a table) where the box body 20 is laid. By such arrangements, the cover 40 is opened for the user to see and take out the tools inside the tool box.

While we have shown and described various embodiments in accordance with the present invention, it is clear to those skilled in the art that further embodiments may be made without departing from the scope of the present invention.

What is claimed is:

1. A locking structure for a tool box, comprising:

a box body with a top surface and two lateral surfaces at two sides of the top surface, on the top surface being provided two opposed lines of positioning hooks, at one end of the box body being formed an engaging groove, and at another end of the box body being formed two round pivoting holes which are located at the two lateral surfaces;

a handle with two assembling rods and a connecting portion connected to one end of each of the assembling rods, in the middle of each of the assembling rods being formed a rotating hole, and at another end of each of the assembling rods being formed a connecting pivot which is pivotally inserted in the pivoting holes of the box body, so that the handle is pivotally coupled to the box body; and a cover with an engaging end and a pivoting end, at each of two sides of the pivoting end being formed a rotating pivot, between the engaging end and the pivoting end being disposed a plate, the cover being pivoted to the handle by inserting the rotating pivots in the rotating holes of the handle.

2. The locking structure for a tool box as claimed in claim 1, wherein at each of top and lower edges of the top surface of the box body is formed a positioning hole, and the cover is provided with two positioning retainers to be engaged with the positioning holes of the box body.

3. The locking structure for a tool box as claimed in claim 2, wherein each of the positioning retainers has a locking end to be engaged in the positioning holes of the box body, and at a terminal edge of the engaging end is formed an engaging rib to be engaged in the engaging groove of the box body.

4. The locking structure for a tool box as claimed in claim 1, wherein the positioning hooks are arranged in an order from large to small.

5. The locking structure for a tool box as claimed in claim 1, wherein an engaging portion and a positioning block are formed around each of the pivoting holes of the box body, and beside each of the connecting pivots is formed a locking groove.

6. The locking structure for a tool box as claimed in claim 5, wherein a stop cavity is a formed at an end of each of the locking grooves, the engaging portions of the box body are restricted in the stop cavities, and an inferior angle is defined between the handle and the box body.

7. The locking structure for a tool box as claimed in claim 6, wherein the inferior angle is 60 degrees.

8. A locking structure for a tool box, comprising:

a box body with a top surface and two lateral surfaces at two sides of the top surface, on the top surface being provided two opposed lines of positioning hooks, at each of top and lower edges of the top surface of the box body being formed a positioning hole, at one end of the box body being formed an engaging groove, and at another end of the box body being formed two round pivoting holes which are located at the two lateral surfaces, an engaging portion and a positioning block being formed around each of the pivoting holes of the box body;

a handle with two assembling rods and a connecting portion connected to one end of each of the assembling rods, in the middle of each of the assembling rods being formed a rotating hole, at another end of each of the assembling rods being formed a connecting pivot which is pivotally inserted in the pivoting holes of the box body, so that the handle is pivotally coupled to the box body, beside each of the connecting pivots being formed a locking groove and a stop cavity at the end of the locking groove, the engaging portions of the box body being restricted in the stop cavities, and an inferior angle being defined between the handle and the box body; and a cover with an engaging end and a pivoting end, between the engaging end and the pivoting end being disposed a plate, the cover being provided with two positioning retainers to be engaged with the positioning holes of the box body, the cover being pivoted to the handle via the pivoting end.

9. The locking structure for a tool box as claimed in claim 8, wherein a rotating hole is formed in the middle of each of the assembling rods, at each of two sides of the pivoting end is formed a rotating pivot, and the cover is pivoted to the handle by inserting the rotating pivots in the rotating holes of the handle.

10. The locking structure for a tool box as claimed in claim 9, wherein the inferior angle is 60 degrees.

11. A locking structure for a tool box, comprising:

a box body with a top surface and two lateral surfaces at two sides of the top surface, on the top surface being provided two opposed lines of positioning hooks, at each of top and lower edges of the top surface of the box body being formed a positioning hole, at one end of the box body being formed an engaging groove;

a handle with two assembling rods and a connecting portion connected to one end of each of the assembling rods, another end of each of the assembling rods being pivotally coupled to the box body; and a cover with an engaging end and a pivoting end, at a terminal edge of the engaging end being formed an engaging rib, the pivoting end being pivoted to the assembling rods of the handle, between the engaging end and the pivoting end being disposed a plate, the cover being provided with two positioning retainers to be engaged with the positioning holes of the box body, each of the positioning retainers being provided with a locking end, the cover being pivoted to the handle via the pivoting end, the engaging rib being engaged in the engaging groove of the box body, the locking ends being locked in the positioning holes, and when the locking ends are damaged or destroyed, the positioning retainers will be disengaged from the positioning holes of the box body.

12. The locking structure for a tool box as claimed in claim 11, wherein a rotating hole is formed in the middle of each of the assembling rods, at each of two sides of the pivoting end is formed a rotating pivot, and the cover is pivoted to the handle by inserting the rotating pivots in the rotating holes of the handle.

13. The locking structure for a tool box as claimed in claim 12, wherein two round pivoting holes are formed at another end of the box body and located at the two lateral surfaces, an engaging portion is formed around each of the pivoting holes of the box body, at another end of each of the assembling rods is formed a connecting pivot which is pivotally inserted in the pivoting holes of the box body, so that the handle is pivotally coupled to the box body, beside, each of the connecting pivots is formed a locking groove and a stop cavity at the end of the locking groove, the engaging portions of the box body is restricted in the stop cavities, and an inferior angle is defined between the handle and the box body.

14. The locking structure for a tool box as claimed in claim 13, wherein the inferior angle is 60 degrees.

* * * * *